US006385946B1

(12) United States Patent
Singh

(10) Patent No.: US 6,385,946 B1
(45) Date of Patent: May 14, 2002

(54) SYSTEM AND METHOD FOR PRODUCING FOLDED ARTICLES

(75) Inventor: Balbir Singh, Media, PA (US)

(73) Assignee: Ethicon, Somerville, NJ (US)

( * ) Notice: Subject to any disclaimer, the term of this patent is extended or adjusted under 35 U.S.C. 154(b) by 0 days.

(21) Appl. No.: 09/387,093

(22) Filed: Aug. 31, 1999

(51) Int. Cl.[7] ..... B65B 63/04
(52) U.S. Cl. ..... 53/429; 493/416; 53/498
(58) Field of Search ..... 53/429, 116, 117, 53/498, 520, 435; 493/416, 420, 424, 434

(56) References Cited

U.S. PATENT DOCUMENTS

| | | | | | |
|---|---|---|---|---|---|
| 2,165,786 | A | | 7/1939 | Christman | 270/66 |
| 2,870,840 | A | | 1/1959 | Kwitek | 164/68 |
| 3,489,406 | A | | 1/1970 | Nystrand | 270/39 |
| 3,689,061 | A | | 9/1972 | Nystrand | 270/66 |
| 3,740,919 | A | * | 6/1973 | Heisler | 53/26 |
| 3,805,474 | A | * | 4/1974 | Gerstein | 53/117 |
| 3,870,292 | A | | 3/1975 | Bradley | 270/68 R |
| 4,163,548 | A | | 8/1979 | Nystrand | 270/39 |
| 4,190,241 | A | | 2/1980 | Krueger | 270/47 |
| 4,272,066 | A | | 6/1981 | Bouda | 493/418 |
| 4,328,655 | A | * | 5/1982 | Spencer et al. | 53/439 |
| 4,349,185 | A | | 9/1982 | Small et al. | 270/32 |
| 4,360,194 | A | | 11/1982 | Bradley | 270/51 |
| 4,521,209 | A | | 6/1985 | DeFresne | 493/432 |
| 4,625,957 | A | | 12/1986 | DuFresne | 271/214 |
| 4,655,739 | A | | 4/1987 | Pratt et al. | 493/357 |
| 4,778,441 | A | | 10/1988 | Couturier | 493/425 |
| 4,917,665 | A | | 4/1990 | Couturier | 493/472 |
| 5,057,069 | A | | 10/1991 | Marion | 493/395 |
| 5,566,531 | A | * | 10/1996 | Nordstrom et al. | 53/466 |
| 5,640,831 | A | * | 6/1997 | Harrod et al. | 53/429 |
| 6,009,689 | A | * | 1/2000 | O'Connor | 53/429 |
| 6,182,418 | B1 | * | 2/2001 | McFarland | 53/411 |

FOREIGN PATENT DOCUMENTS

| | | |
|---|---|---|
| DE | 3227270 | 1/1984 |
| DE | 19908169 | 9/1999 |
| FR | 2679824 | 5/1993 |

OTHER PUBLICATIONS

PCT Search Report dated Nov. 29, 2000.

* cited by examiner

*Primary Examiner*—Rinaldi I. Rada
*Assistant Examiner*—John Paradiso
(74) *Attorney, Agent, or Firm*—Baker Botts L.L.P.

(57) ABSTRACT

A system for producing folded articles includes a cutting station (56) operable to segment a fabric web (42, 44) into a continuous stream of individual web segments (74, 76). The system also includes a first folding station (58) operable to fold each of the web segments (74, 76). The system further includes a spacing station (88) operable to receive the stream of web segments (74, 76) from the folding station (58) and deliver the stream of web segments (74, 76) at a predetermined spacing to correspond with a packaging registration.

19 Claims, 7 Drawing Sheets

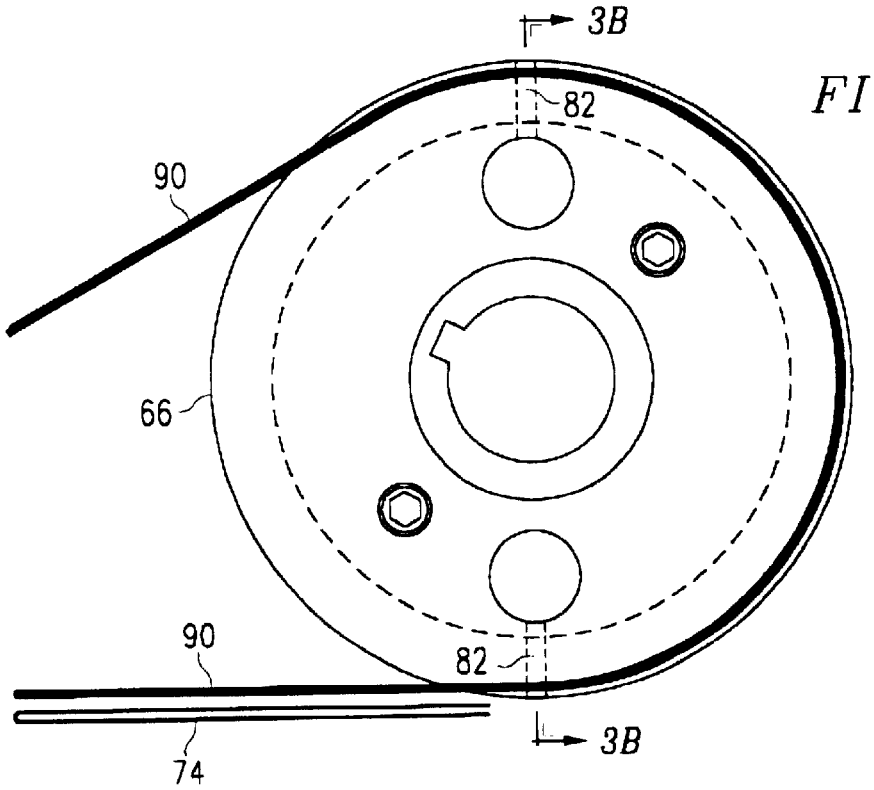
FIG. 3A
FIG. 3B
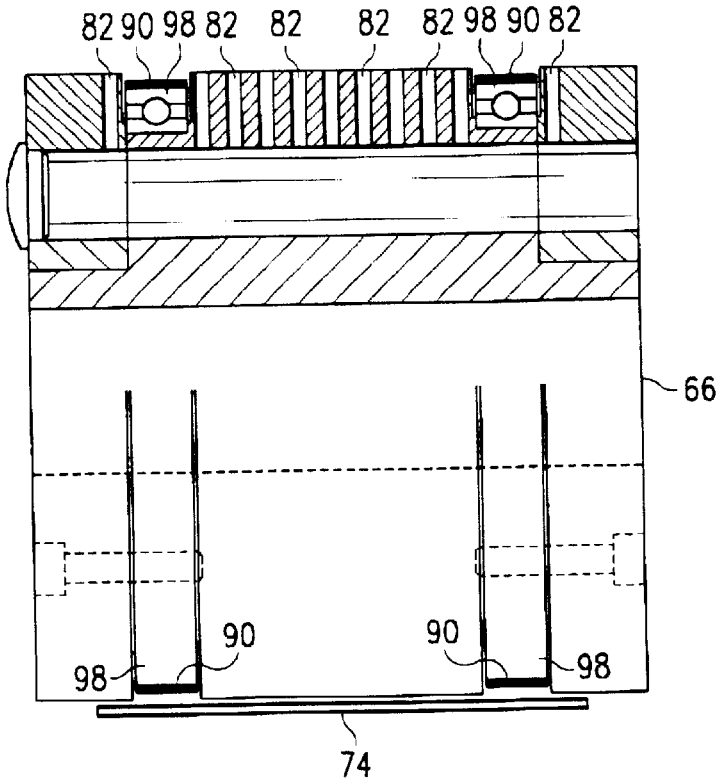

SYSTEM AND METHOD FOR PRODUCING FOLDED ARTICLES

TECHNICAL FIELD OF THE INVENTION

The present invention relates generally to the field of fabric or paper converting processes and machinery, and more particularly, to a system and method for producing folded articles.

BACKGROUND OF THE INVENTION

Folding systems are generally used for folding and stacking products such as napkins, towels and/or other paper or fabric products. For example, one method for producing a quarter-folded product includes longitudinally folding a web by passing the web over a plow or similar V-shaped plate to create a two-ply web. The two-ply web is then passed through a series of rollers and transversely cut into discrete segments. Thereafter, through the use of a vacuum roller, an intermediate portion of the two-ply web segment is gripped and caused to fold on itself transversely, thereby developing a quarter-folded web having an area that is one quarter the area of the unfolded web. The quarter-folded web products are thereafter horizontally or vertically stacked with other quarter-folded web products.

To increase efficiency, a double-wide parent roll may also be used to produce two folded web products simultaneously. For example, the double-wide parent roll may be slit longitudinally into web halves and each web half simultaneously processed using a duplicate series of rollers to produce a pair of folded web products. The pair of folded web products may then be superposed and stacked with other superposed pairs of folded web products. The stacks of folded web products may then be delivered into a magazine for subsequent packaging.

Prior fabric folding systems and methods suffer several disadvantages. For example, prior systems do not readily accommodate individual packaging of a web product or pair of web products. For example, prior systems generally produce vertical or horizontal stacks of folded web products. The stacks are then subsequently divided into smaller stacks of a specified count for subsequent handling and packaging.

SUMMARY OF THE INVENTION

Accordingly, a need has arisen for a system and method for producing folded articles that accommodates individual packaging of folded web products. The present invention provides a system and method for producing folded articles that address the shortcomings of prior systems and methods.

According to one embodiment of the present invention, a system for producing folded articles includes a cutting station operable to segment a fabric web into a continuous stream of individual web segments. The system also includes a first folding station operable to fold each of the web segments. The system further includes a spacing station operable to receive the stream of web segments from the folding station and deliver the stream of web segments at a predetermined spacing to correspond with a packaging registration.

According to another embodiment of the present invention, a method for producing folded articles includes segmenting a fabric web into a continuous stream of individual web segments at a cutting station. The method also includes folding each of the web segments at a folding station. The method further includes receiving the web segments from the folding station at a spacing station and spacing the web segments at a predetermined interval at the spacing station to correspond with a packaging registration.

The technical advantages of the present invention include providing a system for producing folded articles that delivers the folded articles at a predetermined spacing to accommodate individual packaging requirements. For example, according to one aspect of the present invention, a stripper belt decelerates the folded web products to adjust the spacing between successive folded web products. The system then delivers the folded web products at the predetermined spacing to match a packaging registration.

Other technical advantages of the present invention will be readily apparent to one skilled in the art from the following figures, descriptions and claims.

BRIEF DESCRIPTION OF THE DRAWINGS

For a more complete understanding of the present invention and the advantages thereof, reference is now made to the following description taken in connection with the accompanying drawings in which:

FIGS. 3A and 3B are diagrams illustrating a spacing station of the system in accordance with an embodiment of the present invention;

DETAILED DESCRIPTION OF THE INVENTION

Embodiments of the present invention and the advantages thereof are best understood by referring to the following descriptions and drawings, wherein like numerals are used for like and corresponding parts of the various drawings.

Figure 1A:
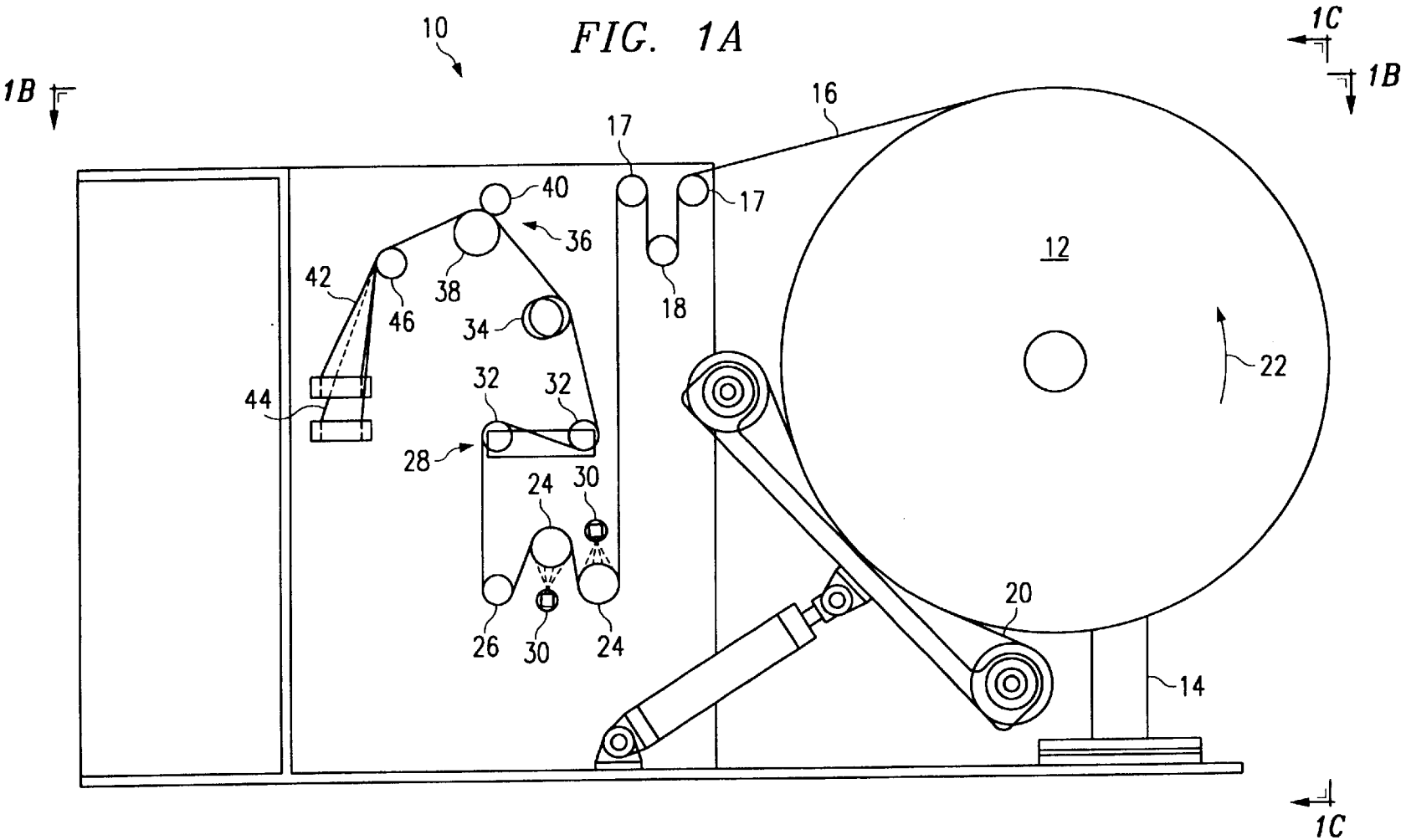
FIGS. 1A–1C are diagrams illustrating a system for producing folded articles in accordance with an embodiment of the present invention.
Figure 1B:
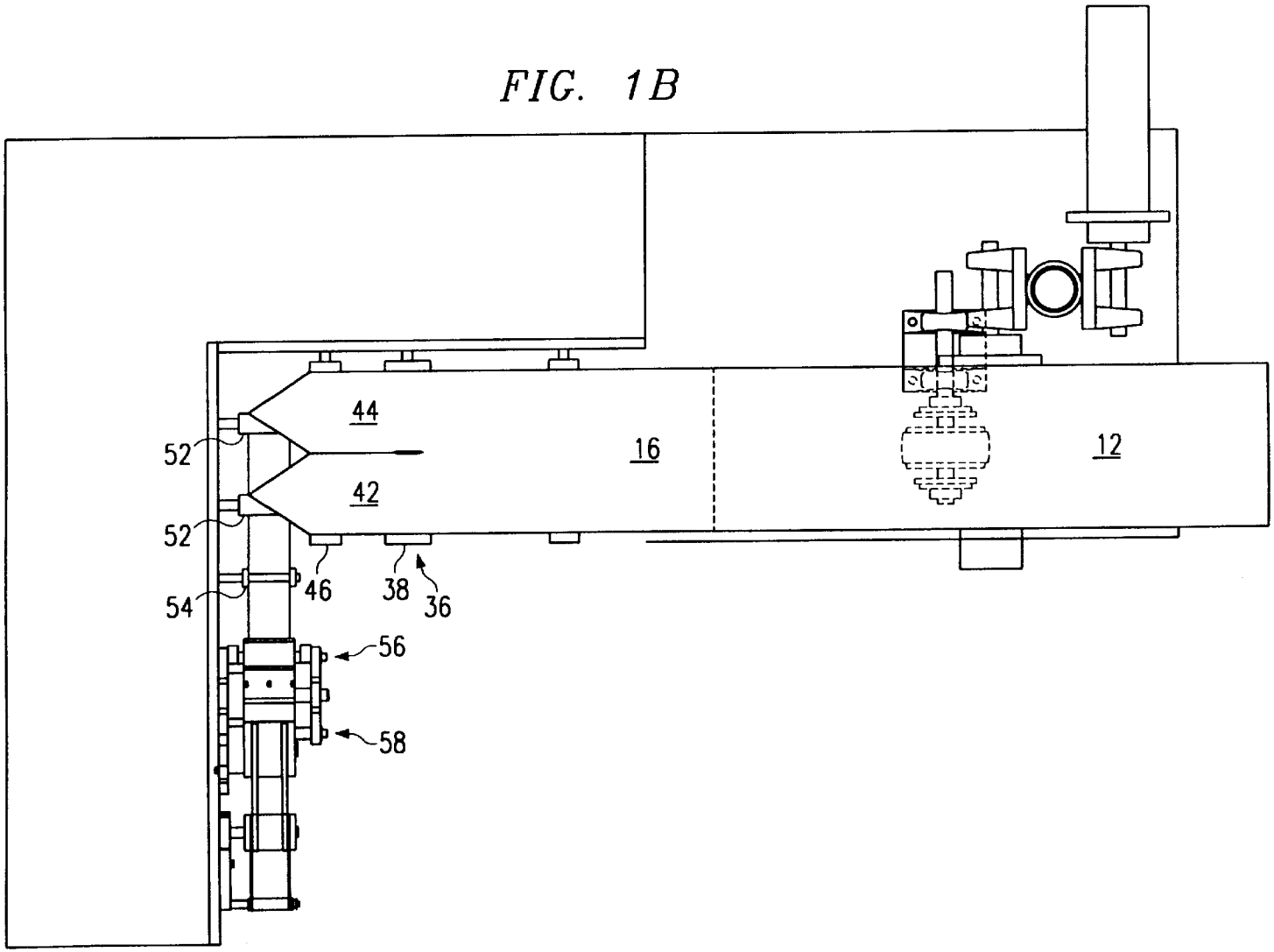
Figure 1C:
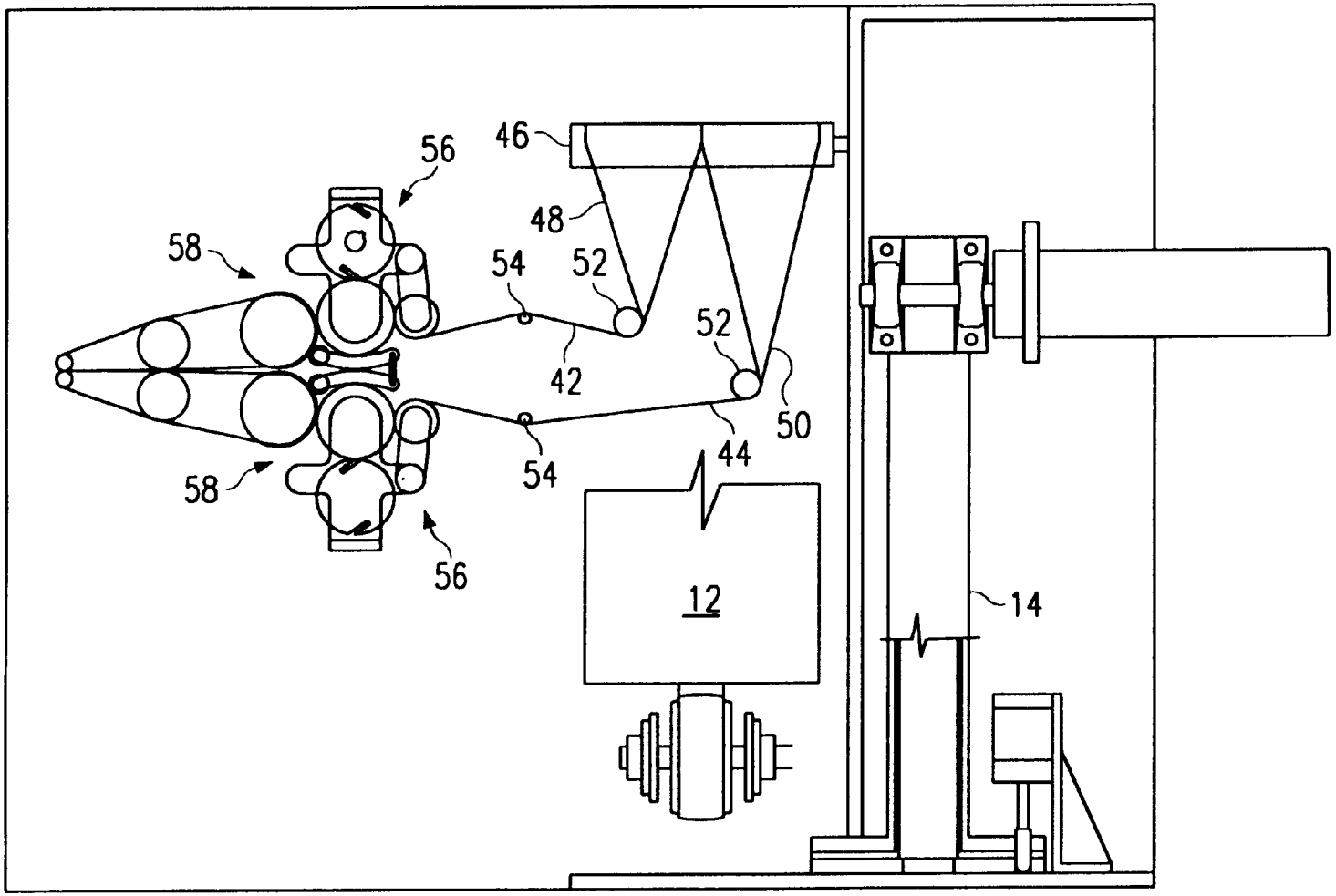

FIGS. 1A–1C are diagrams illustrating a system 10 for producing folded articles in accordance with an embodiment of the present invention. Referring to FIG. 1A, system 10 comprises a parent roll 12 of material such as fabric rotatably mounted to an unwind stand 14. Parent roll 12 may comprise paper, woven material, non-woven material, or other suitable materials for producing folded articles. A primary fabric web 16 from parent roll 12 is fed through detour rollers 17 and a weighted dancer roller 18 positioned downstream of parent roll 12. As used throughout this description, "downstream" relates to the direction of fabric travel through system 10, whereas the term "upstream" refers to a direction opposite that of fabric travel. Dancer roller 18 moves up or down in response to changes in fabric web 16 tension, and using a sensor (not explicitly shown), controls a feed rate of fabric web 16 by modulating a speed of a drive belt 20 as a function of fabric web 16 tension. In operation, fabric web 16 is unwound from parent roll 12 by rotating parent roll 12 in a direction indicated by arrow 22.

Fabric web 16 is fed downstream from detour rollers 17 to draw and calender rollers 24. Draw and calendar rollers 24 rotate with such a speed of rotation that rollers 24 pull fabric web 16 and feed fabric web 16 downstream through a detour roller 26 to an alignment station 28. Fabric web 16 may also receive a moisturizing agent delivered by misters 30 as fabric web 16 passes through draw and calendar rollers 24. Additionally, other fabric treatment process may be performed on fabric web 16, such as, but not limited to, heat calendering, embossing, and perforating.

Alignment station 28 includes guide rollers 32 to guide fabric web 16 laterally with respect to a longitudinal downstream direction of fabric web 16 in response to edge sensor (not explicitly shown) feedback. In operation, fabric web 16 is fed from alignment station 28 downstream to a spreader roller 34 and cutting station 36. Spreader roller 34 may be used to remove wrinkles in fabric web 16 prior to fabric web 16 reaching cutting station 36. Cutting station 36 includes a driven slitter roller 38 and an anvil roller 40 for separating fabric web 16 into two substantially equal width web streams 42 and 44. Thus, alignment station 28 aligns fabric web 16 so that cutting station 36 provides substantially equally width web streams 42 and 44.

Referring to FIGS. 1B and 1C, web streams 42 and 44 are fed downstream from cutting station 46 over a detour roller 46 to fold plows 48 and 50, respectively. Fold plows 48 and 50 longitudinally fold web streams 42 and 44, respectively. As illustrated in FIGS. 1B and 1C, fold plows 48 and 50 are used to longitudinally fold web streams 42 and 44, respectively, medially; however, web streams 42 and 44 may be longitudinally folded into other configurations. As illustrated in FIG. 1C, fold plow 50 is designed to have a length greater than a length of fold plow 48 so that web streams 48 and 50 may be fed downstream over detour rollers 52 and guide rollers 54 in above-and-below relation to each other. Thus, web streams 42 and 44 pass over fold plows 48 and 50 and turn approximately ninety degrees to horizontally feed web streams 42 and 44 to a cutting station 56 and a folding station 58.

Figure 2A:
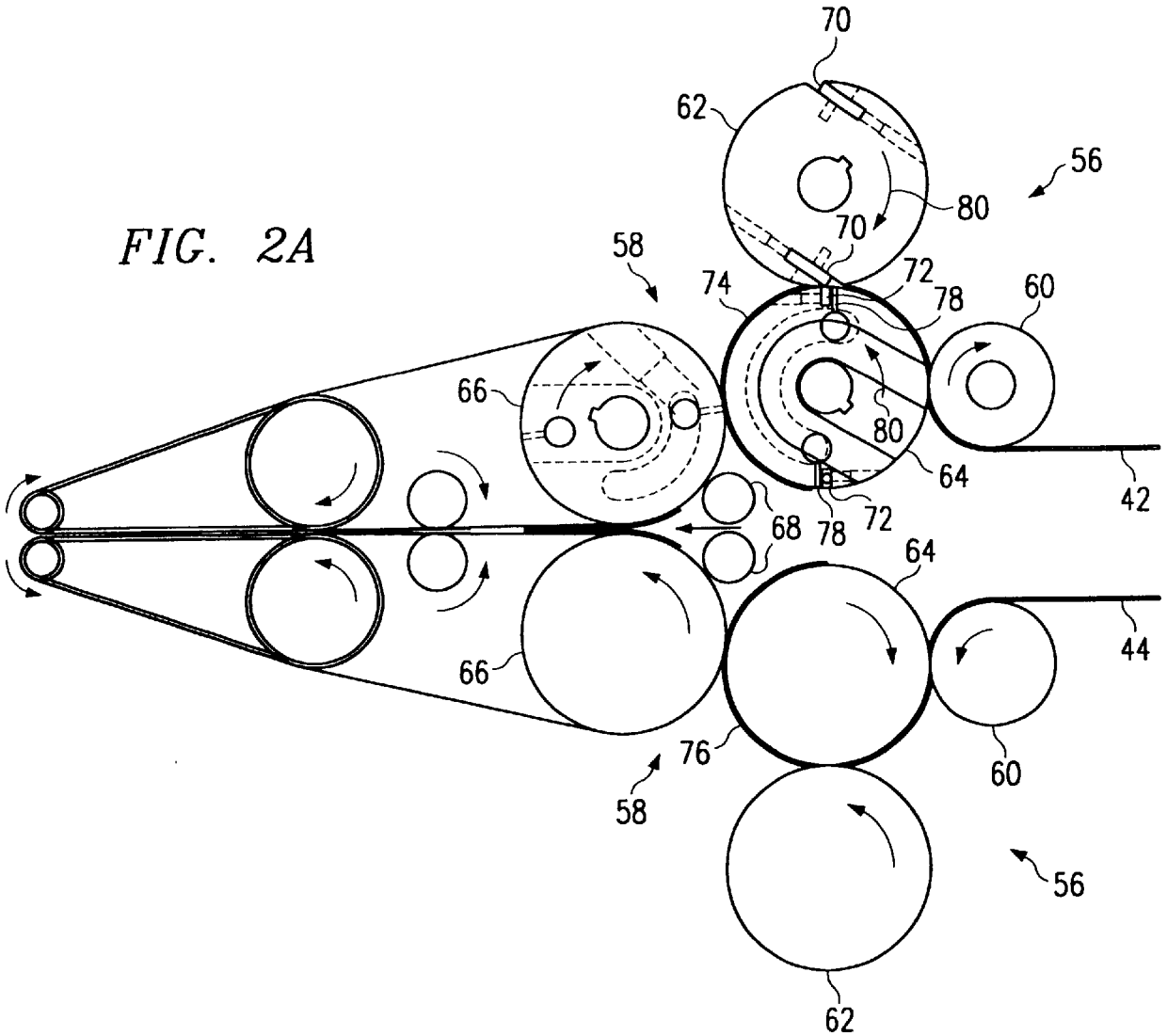
FIGS. 2A and 2B are diagrams illustrating a cutting station and a folding station of the system in accordance with an embodiment of the present invention.
Figure 2B:
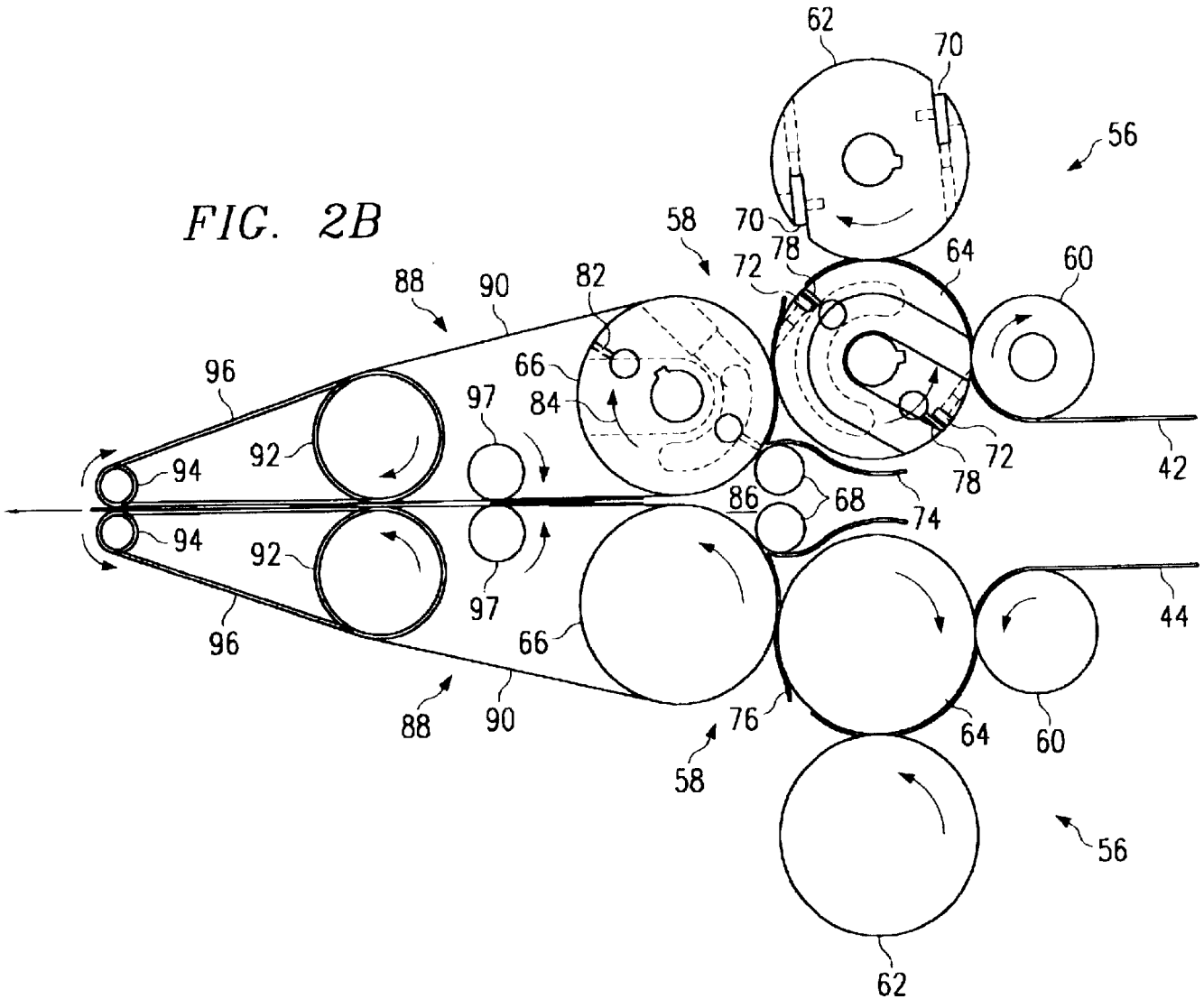

FIGS. 2A and 2B are diagrams illustrating cutting station 56 and folding station 58 in accordance with an embodiment of the present invention. Referring to FIG. 2A, cutting station 56 comprises two vertically mirrored-image sets of rollers, each set comprising a rider roller 60, a cutter roller 62, and an anvil roller 64. Folding station 58 comprises two vertically mirror-imaged sets of rollers about a horizontal axis, each set comprising a folding roller 66 and an ironing roller 68. For ease of illustration, only the progression of web stream 42 through cutting station 56 and folding station 58 is described below. It should be understood that web stream 44 follows a similar progression through cutting station 56 and folding station 58. However, cutting station 56 and folding station 58 may also comprise mirror-imaged sets of rollers about a vertical axis or other suitable inclination to accommodate fabric travel in any direction.

Cutter roller 62 comprises protruding blades 70 which operate in conjunction with corresponding anvils 72 of anvil roller 64 to transversely segment web stream 42 into a continuous stream of individual web segments 74. In a similar manner, cutter roller 62 and anvil roller 64 also operate to transversely segment web stream 44 into a continuous stream of web segments 76. Anvil roller 64 comprises axially extending vacuum ports 78 to control the leading edge of each web segment 74. In the embodiment illustrated in FIG. 2A, cutter roller 62 comprises two blades 70 and anvil roller 64 comprises two anvils 72 and two vacuum ports 78 for fabricating web segments 74 having a longitudinal length equal to approximately half the circumference of cutter roller 62 and anvil roller 64. However, additional or fewer blades 70, anvils 72 and vacuum ports 78 may be used to produce web segments 74 of varying length.

Thus, in operation, web stream 42 is fed through a nip defined by adjacent rollers 60 and 64. Web stream 42 is then fed to a nip defined by adjacent rollers 62 and 64 where vacuum port 78 of anvil roller 64 is valved on to retain a leading edge of web stream 42. As cutter roller 62 and anvil roller 64 rotate in a direction indicated by arrows 80, blade 70 of cutter roller 62 operates in conjunction with anvil 72 of anvil roller 64 to transversely segment web stream 42 into web segments 74.

Referring to FIG. 2B, vacuum ports 82 of folding roller 66 are valved on to hold the generally central portion of web segment 74 as folding roller 66 rotates in a direction indicated by arrow 84. Additionally, vacuum port 78 of anvil roller 64 is valved off, thereby releasing the leading edge of web segment 74. The generally central portion of web segment 74 is then fed to a nip defined by adjacent rollers 66 and 68 to transversely fold web segment 74, thereby forming a quarter-folded web segment 74. As described above, folding roller 66 may comprise additional or fewer vacuum ports 82 to accommodate varying lengths of web segments 74 produced by cutting station 56.

As folding rollers 66 continue rotation in direction 84, web segments 74 and 76 are brought into a nip 86 formed by the relationship of adjacent folding rollers 66 where web segments 74 and 76 are arranged in a face-to-face superposed relation. The superposed web segments 74 and 76 are then fed to a spacing station 88 where the spacing or interval between successive superposed web segments 74 and 76 is regulated to coordinate with a subsequent packaging registration.

For example, superposed web segments 74 and 76 may be transferred to a packaging station (not explicitly shown) to individually package each superposed pair of web segments 74 and 76. The packaging station may comprise a rotary sealer (not explicitly shown) or other suitable type of automatic packaging system. Thus, the packaging station may include a registration or interval for individually packaging each pair of superposed web segments 74 and 76. Accordingly, the superposed web segments 74 and 76 are delivered to the packaging station at a spacing substantially matching the packaging registration.

Spacing station 88 comprises stripper belts 90 coupled to spacing rollers 92 and folding rollers 66. Spacing rollers 92 drive stripper belts 90 at a predetermined velocity independently from a velocity of folding rollers 66 to modify the spacing between successive pairs of web segments 74 and 76 as web segments 74 and 76 are received from folding rollers 66. For example, stripper belts 90 may be driven at a velocity greater than or less than a velocity of folding rollers 66 to increase or decrease, respectively, the spacing between successive pairs of superposed web segments 74 and 76. In operation, as folding rollers 66 continue rotation in direction 84, vacuum ports 82 of folding rollers 66 are valved off, thereby releasing web segments 74 and 76. Adjacent stripper belts 90 are disposed in above-and-below relation to each other and operate to pinch and secure web segments 74 and 76 together as web segments 74 and 76 are released by folding rollers 66.

System 10 may also include delivery rollers 94 and belts 96 for further transfer of superposed web segments 74 and 76 from stripper belts 90 to the packaging station. In operation, superposed web segments 74 and 76 continue downstream and may be transferred from stripper belts 90 to belts 96 for delivery to the packaging station. Belts 96 are driven by delivery rollers 94 at a velocity substantially equal to the velocity of stripper belts 90 to provide a smooth transfer of superposed web segment 74 and 76 from stripper belts 90 to belts 96. System 10 may also include creasing rollers 97 for simultaneously creasing the folded web segments 74 and 76 as web segments 74 and 76 are transferred using stripper belts 90.

FIG. 3A is a diagram illustrating the relationship between folding roller 66 and stripper belt 90, and FIG. 3B is a partial section view of folding roller 66 and stripper belt 90 illustrated in FIG. 3A taken along the line 3B—3B of FIG. 3A. Referring to FIG. 3B, folding rollers 66 comprise bearings 98 extending circumferentially about folding rollers 66 for receiving stripper belts 90. Bearings 98 are positioned slightly below the outer circumference of folding rollers 66 to prevent interference with folding operations performed using folding rollers 66. Thus, stripper belts 90 may be operated at a velocity different from the rotational velocity of folding rollers 66. Therefore, in operation, as web segments 74 and 76 are transferred from folding rollers 66 to stripper belts 90, the velocity of web segments 74 and 76 may be increased or decreased to increase or decrease, respectively, the spacing between successive web segments 74 and 76.

Figure 4A:
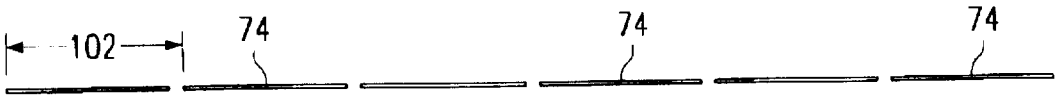
FIG. 4 is a diagram illustrating the spacing between successive folded articles in accordance with an embodiment of the present invention.
Figure 4B:
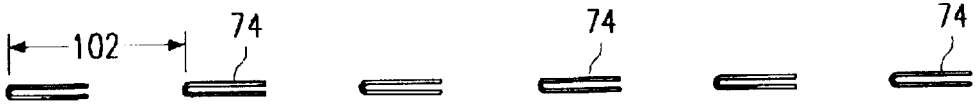
Figure 4C:
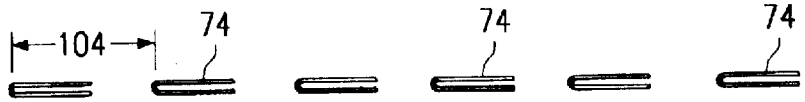

FIG. 4 is a diagram illustrating a spacing relationship between successive web segments 74 as web segments 74 are fed downstream from cutting station 56, through folding station 58, and then to spacing station 88. At cutting station 56, web segments 74 have a spacing or interval as measured from leading edge to leading edge of successive web segments 74 as indicated by dimension 102. After web segments 74 are transversely folded at folding station 58, the spacing between successive web segments 74 as measured from leading edge to leading edge of folded successive web segments 74 remains substantially constant as indicated by dimension 102.

In the embodiment illustrated in FIG. 4, stripper belts 90 are driven at a velocity less than a velocity of folding rollers 66, thereby negatively accelerating web segments 74 as web segments 74 are transferred from folding roller 66 to stripper belts 90. Thus, the spacing or interval between successive web segments 74 is reduced as indicated by dimension 104. However, stripper belts 90 may also be driven at a velocity greater than the velocity of folding roller 66, thereby positively accelerating web segments 74 to increase the spacing between successive web segments 74.

Therefore, the present invention provides greater flexibility than prior systems by delivering web products at a predetermined spacing to correspond with spacing or registration requirements of packaging systems. Although the present invention has been described as being associated with producing superposed web products, the present invention may also be associated with producing a single web product without departing from the intended scope of the present invention.

Figure 5:
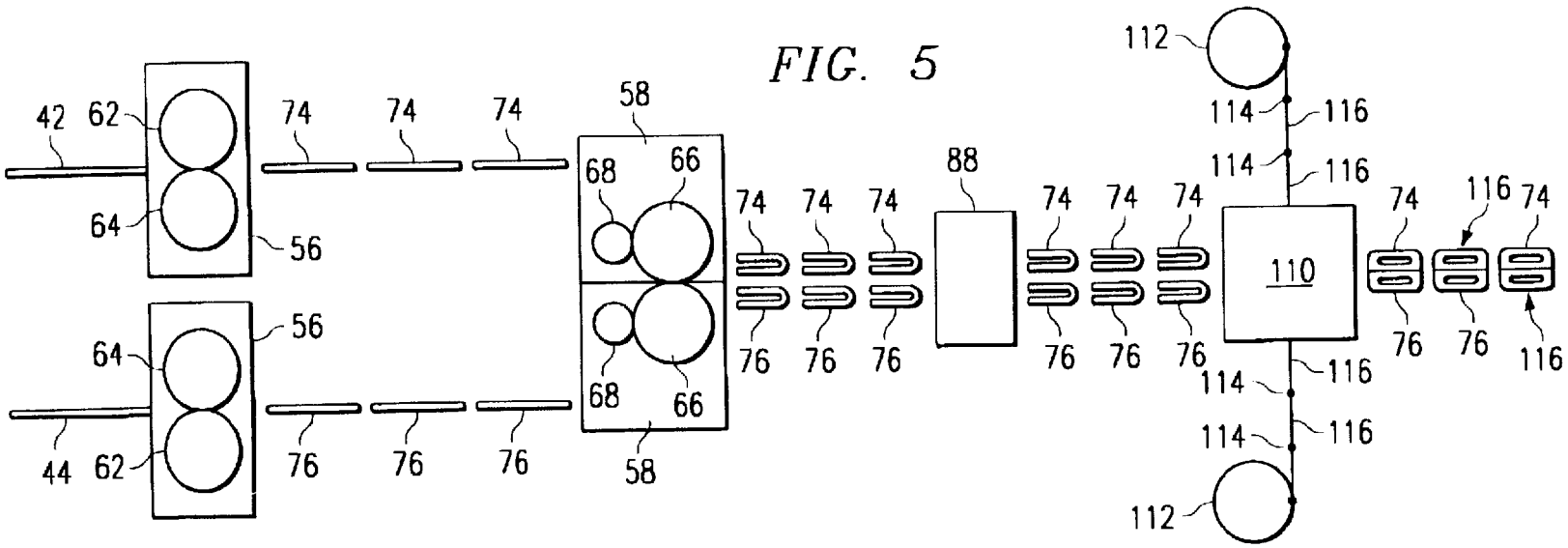
FIG. 5 is a diagram illustrating a routing of articles through the system in accordance with an embodiment of the present invention.

FIG. 5 is a diagram illustrating a routing of articles through system 10 in accordance with an embodiment of the present invention. As illustrated in FIG. 5, web streams 42 and 44 are each fed to cutting stations 56 where cutter rollers 62 and anvil rollers 64 cooperate to segment web streams 42 and 44 into a continuous stream of individual web segments 74 and 76, respectively. Web segments 74 and 76 are then each fed downstream to folding stations 58 where folding rollers 66 and ironing rollers 68 cooperate to fold each of the web segments 74 and 76. Additionally, adjacent folding rollers 66 also cooperate to superpose the folded web segments 74 and 76.

Superposed web segments 74 and 76 are then fed downstream to spacing station 88 where the spacing or interval between successive pairs of web segments 74 and 76 is modified to correspond with a spacing registration. For example, superposed web segments 74 and 76 may be fed downstream to a packaging station 110 where packaging material 112 is received to individually package each pair of superposed web segments 74 and 76. Packaging material 112 may be formed and/or delivered to packaging station 110 having a predetermined interval or registration 114 between successive packaging units 116. Thus, system 10 modifies the spacing of each superposed pair of web segments 74 and 76 to correspond with packaging registration 114. Therefore, system 10 provides greater flexibility than prior systems by modifying the spacing between successive pairs of web segments 74 and 76 to support individual packaging of pairs of web segments 74 and 76.

Although the present invention and its advantages have been described in detail, it should be understood that various changes, substitutions, and alterations can be made therein without departing from the spirit and scope of the present invention as defined by the appended claims.

What is claimed is:

1. A method for producing folded articles comprising:

segmenting a web into a continuous stream of individual web segments at a cutting station;

folding each of the web segments at a folding station;

receiving the web segments on a stripper belt of a spacing station from a folding roller of the folding station, the stripper belt coupled to the folding roller; and spacing the web segments at a predetermined interval at the spacing station to correspond with a packaging registration.

2. The method of claim 1, wherein spacing comprises modifying a velocity of the web segments as the web segments are received from the folding station to obtain the predetermined interval.

3. The method of claim 1, wherein receiving comprises receiving the web segments from the folding station at a first velocity, and wherein spacing comprises accelerating or decelerating the web segments to a second velocity to obtain the predetermined interval.

4. The method of claim 1, wherein spacing comprises operating the stripper belt at a velocity independent of a velocity of the folding roller to obtain the predetermined interval.

5. The method of claim 4, wherein the stripper belt is coupled to a spacing roller and a surface roller bearing of the folding roller, and wherein spacing comprises operating the spacing roller to drive the stripper belt at a velocity different than a velocity of the folding roller to obtain the predetermined interval.

6. The method of claim 1, further comprising longitudinally folding the fabric web prior to segmenting the fabric web, and wherein folding each of the web segments comprises transversely folding each of the web segments.

7. A system for producing folded articles comprising:

a cutting station operable to segment a web into a continuous stream of individual web segments;

a first folding station operable to fold each of the web segments; and a spacing station comprising a spacing roller and a stripper belt coupled between the spacing roller and a folding roller of the folding station, the spacing station operable to receive the stream of web segments from the folding station and deliver the stream of web segments at a predetermined spacing to correspond with a packaging registration.

8. The system of claim 7, wherein the spacing station is operable to receive the web segments from the folding station at a first velocity and accelerate the web segments to a second velocity different than the first velocity to obtain the predetermined spacing.

9. The system of claim 7, wherein the folding roller operates at a first velocity, and wherein the stripper belt operates at a second velocity, the second velocity greater than or less than the first velocity to obtain the predetermined spacing.

10. The system of claim 7, wherein the stripper belt is driven by the spacing roller at a velocity operable to obtain the predetermined spacing.

11. The system of claim 10, wherein the folding roller comprises a surface roller bearing, and wherein the stripper belt is coupled to the surface roller bearing of the folding roller.

12. The system of claim 7, further comprising a second folding station operable to longitudinally fold the fabric web prior to the fabric web reaching the cutting station.

13. The system of claim 12, wherein the first folding station is operable to transversely fold the web segments to produce quarter-folded web segments.

14. The system of claim 7, wherein the folding roller operates at a first velocity, the folding roller comprising a surface roller bearing circumferentially disposed about the folding roller, and wherein the stripper belt is coupled to the surface roller bearing, the stripper belt operable to receive the web segments from the folding roller, the stripper belt operated at a second velocity greater than or less than the first velocity to obtain the predetermined spacing.

15. A system for producing folded fabric articles comprising:

a first cutter roller operable to segment a first fabric web into a continuous first stream of individual web segments;

a second cutter roller operable to segment a second fabric web into a continuous second stream of individual web segments;

a first folding roller operable to fold each of the web segments of the first stream;

a second folding roller operable to fold each of the web segments of the second stream, the first and second folding rollers defining a nip for receiving and superposing the folded web segments from the first and second streams; and a spacing station operable to receive the superposed web segments from the first and second folding rollers and space the superposed web segments at a predetermined interval to correspond with a packaging registration, the spacing station comprising:

a first spacing roller;

a second spacing roller;

a first stripper belt coupled to the first spacing roller and the first folding roller;

a second stripper belt coupled to the second spacing roller and the second folding roller; and wherein the first and second spacing rollers are operable to drive the first and second stripper belts at a velocity different than a rotational velocity of the first and second folding rollers to obtain the predetermined interval.

16. The system of claim 15, wherein the first and second folding rollers are each operating at a first velocity, and wherein the spacing station is operable to accelerate the superposed web segments from the first velocity to a second velocity to obtain the predetermined interval.

17. The system of claim 15, wherein the spacing station comprises a first stripper belt disposed in above-and-below relation to a second stripper belt, wherein the first and second stripper belts are operable to receive and secure the superposed web segments from the first and second folding rollers.

18. The system of claim 15, wherein the first and second folding rollers each comprise a surface roller bearing, and wherein the first and second stripper belts are coupled to the surface roller bearings of the respective first and second folding rollers.

19. The system of claim 15, further comprising a cutting station operable to longitudinally separate a primary fabric web into the first and second fabric webs.

* * * * *